United States Patent [19]

Bardai et al.

[11] Patent Number: 5,038,070

[45] Date of Patent: Aug. 6, 1991

[54] FIELD EMITTER STRUCTURE AND FABRICATION PROCESS

[75] Inventors: Zaher Bardai, Torrance; Mario A. Barillas, Carson; Arthur E. Manoly, Rancho Palos Verdes; Robert T. Longo, Arcadia, all of Calif.; Ralph Forman, Rocky River, Ohio

[73] Assignee: Hughes Aircraft Company, Los Angeles, Calif.

[21] Appl. No.: 457,208

[22] Filed: Dec. 26, 1989

[51] Int. Cl.[5] ..... H01J 9/02; H01J 1/02

[52] U.S. Cl. ..... 313/309

[58] Field of Search ..... 445/24, 36, 52; 313/309, 336, 351; 228/189

[56] References Cited

U.S. PATENT DOCUMENTS

| | | | |
|---|---|---|---|
| 4,008,412 | 2/1977 | Yuito et al. | 313/309 |
| 4,020,381 | 4/1977 | Oess et al. | 313/351 X |
| 4,307,507 | 12/1981 | Gray et al. | 313/309 X |
| 4,529,836 | 7/1985 | Powers et al. | 228/189 |

OTHER PUBLICATIONS

Busta et al, Extended Abstracts, vol. 86, No. 1, May 1986, H. H. Busta et al., "Micromachined Tungsten Field Emitters"; pp. 403–404.

*Primary Examiner*—Kenneth J. Ramsey

*Attorney, Agent, or Firm*—Terje Gudmestad; W. K. Denson-Low

[57] ABSTRACT

A plurality of field emitters in the form of hollow, upstanding pointed cones or pyramids formed by a molding process extend from a surface of an electrically conductive layer. An electrically conductive mesh is adhered to an opposite surface of the conductive layer by a high temperature brazing process in electrical connection with the conductive layer. The mesh provides a strong metal base with good thermal conductivity for mounting. Additional elements such as a gate and anode structure may be formed on the conductive layer in alignment with the field emitters to form a field emitting triode array or the like.

27 Claims, 3 Drawing Sheets

FIELD EMITTER STRUCTURE AND FABRICATION PROCESS

BACKGROUND OF THE INVENTION

1. Field of the Invention

The present invention generally relates to field emitter arrays, and more particularly to a process for fabricating a field emitter array including a mesh which provides a strong metal base and good thermal conductivity for mounting.

2. Description of the Related Art

Field emitter arrays typically include a metal/insulator/metal film sandwich with a cellular array of holes through the upper metal and insulator layers, leaving the edges of the upper metal layer (which serves as an accelerator or gate electrode) effectively exposed to the upper surface of the lower metal layer (which serves as an emitter electrode). A plurality of conically-shaped electron emitter elements are mounted on the lower metal layer and extend upwardly therefrom such that their respective tips are located in respective holes in the upper metal layer. If appropriate voltages are applied between the emitter electrode, accelerator electrode, and an anode located above the accelerator electrode, electrons are caused to flow from the respective cone tips to the anode.

This structure is comparable to a triode vacuum tube, providing amplification of a signal applied to the accelerator or gate electrode, and operates best when the space in which the electrodes are mounted is evacuated. The three electrode configuration is known as a field emitting triode or "fetrode". However, numerous other applications for field emitter arrays have been proposed, including extremely high resolution flat panel television displays. A major advantage of the field emitter array concept is that the arrays can be formed by conventional photolithographic techniques used in the fabrication of integrated microelectronic circuits. This enables field emitter elements to be formed with submicron spacing, using process steps integrated with the formation of signal processing and other microelectronic circuitry on a single chip. A general presentation of field emitter arrays is found in an article entitled "The Comeback of the Vacuum Tube: Will Semiconductor Versions Supplement Transistors?", by K. Skidmore, Semiconductor International Industry News, pp. 15–18 (Aug. 1988).

Field emitter arrays have been heretofore formed by two processes, the first of which is described in an article entitled "PHYSICAL PROPERTIES OF THIN-FILM FIELD-EMISSION CATHODES WITH MOLYBDENUM CONES", by C. A. Spindt et al, Journal of Applied Physics, vol. 47, no. 12, pp. 5248–5263 (Dec. 1976). The main steps of the process include depositing an insulator layer and a metal gate electrode layer on a silicon substrate, and forming holes through these layers down to the substrate. Molybdenum is deposited onto the substrate through the holes by electron beam evaporation from a small source. The size of the holes progressively decreases due to condensation of molybdenum on their peripheries. A cone grows inside each hole as the molybdenum vapor condenses on a smaller area, limited by the decreasing size of the aperture, and terminates in a point which constitutes an efficient source of electrons.

The second method of fabricating a field emitter array is disclosed in U.S. Pat. No. 4,307,507, issued Dec. 29, 1981, entitled "METHOD OF MANUFACTURING A FIELD-EMISSION CATHODE STRUCTURE", to H. Gray et al. In this method, a substrate of single crystal material is selectively masked such that the unmasked areas define islands on the underlying substrate. The single crystal material under the unmasked areas is orientation-dependent etched to form an array of holes whose sides intersect at a crystallographically sharp point. Following removal of the mask, the substrate is covered with a thick layer of material capable of emitting electrons which extends above the substrate surface and fills the holes. Thereafter, the material of the substrate underneath the layer of electron-emitting material is etched to expose a plurality of sharp field-emitter tips.

In both of these prior art processes, the field emitters are formed on a substrate made of a material such as silicon, which has relatively low thermal conductivity and physical strength. The structures are brittle and prone to structural failure during subsequent processing, and difficult or impossible to mount in a device package using a method such as high temperature soldering.

SUMMARY OF THE INVENTION

The present invention overcomes the limitations of the prior art processes discussed above by providing a metal mesh which constitutes an electrically conductive support for the field emitters and associated gate and anode structures. The direct ohmic connection between the mesh and field emitters provides an all-metal field emitter structure which is extremely resistant to radiation. The mesh constitutes a strong metal base for the structure which has much greater thermal conductivity than the silicon substrates used in the prior art, and enables the structure to be mounted in an integrated circuit package using a process such as high temperature soldering.

The present process includes forming at least one hole having a pointed bottom in a surface of a substrate which constitutes a mold. An electrically conductive layer of molybdenum or other material is formed on the surface of the substrate including the walls and pointed bottoms of the holes. An electrically conductive mesh is adhered to the conductive layer using high temperature brazing so that the mesh is electrically connected to the conductive layer. The substrate is then etched away to expose upstanding pointed portions of the conductive layer corresponding to the walls and pointed bottoms of the holes, which constitute field emitters. A second substrate may be brazed to the other side of the mesh prior to removal of the first substrate, serving as a base for support of the structure during formation of gate means, anode means, and the like on the conductive layer in alignment with the field emitters. The second substrate is removed after the gate and anode means have been formed.

The structure fabricated by the present process includes a plurality of field emitters in the form of upstanding pointed cones or pyramids which extend from a surface of an electrically conductive layer. An electrically conductive mesh is adhered to an opposite surface of the conductive layer by a high temperature brazing process in electrical connection with the conductive layer. The mesh provides a strong metal base with good thermal conductivity for mounting. Additional elements such as a gate and anode structure may be formed on the conductive layer in alignment with the field emitters to form a field effect triode, flat panel display, or the like.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
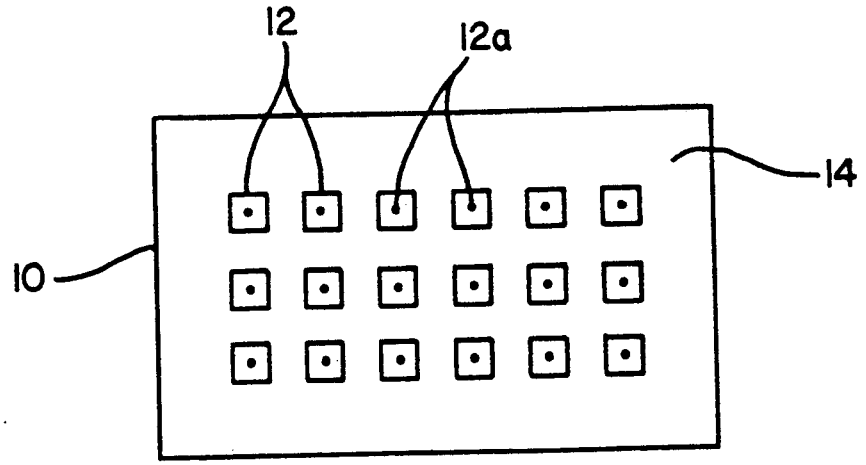
FIG. 1 is a plan view illustrating a substrate with pyramidal holes etched in a surface thereof provided in accordance with a first step of the present invention.

Referring now to FIG. 1 of the drawing, a substrate 10 is formed with a plurality of pyramidal holes 12 in a surface 14 thereof, which will correspond to field emitters upon completion of the present process. The holes 12 have pointed bottoms 12*a*. The substrate 10 is preferably formed of crystalline silicon in order to facilitate etching of the holes 12, although it may be formed of alternative materials such as germanium or any other crystal material that will allow orientation dependent etching. Although three rows of six holes each are shown in the drawing to illustrate the principle of the invention, any number of holes from one to thousands or more may be provided to form a high density array of field emitters. The number of holes and the spacing therebetween is limited only by the state of technology in the arts of photolithography and microcircuit fabrication. Currently, it is possible to form the holes at spacings of somewhat less than one micron.

Although the present invention is not so limited, the holes 12 may be formed in the surface 14 of the substrate by orientation-dependent etching as disclosed in the above referenced patent to Gray. More specifically, a photoresist pattern (not shown) having holes therethrough corresponding to the holes 12 is deposited on the surface 14 of the substrate 12. The surface 14 is then subjected to etching in potassium hydroxide or other solution which selectively attacks the (100) crystallographic planes of n-type or low and moderately doped p-type silicon. The etch will proceed to attack at a rapid rate until (111) planes are encountered, at which point the etch stops or is significantly slowed down. This action tends to produce a pyramidal hole whose (111) sides intersect at a crystallographically sharp point which defines the bottoms 12*a*. The photoresist is then removed to expose the surface 14.

Figure 2:
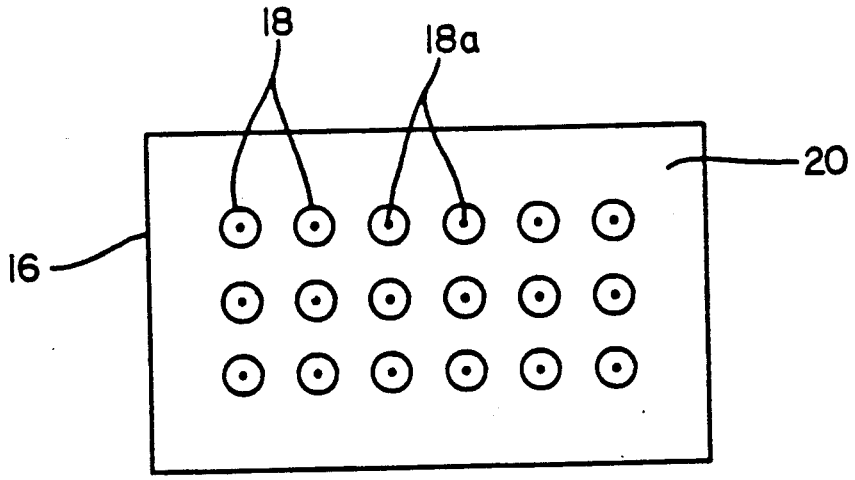
FIG. 2 is similar to FIG. 1, but illustrates a substrate with conical holes etched in the surface thereof.

FIG. 2 illustrates an alternative configuration in which a substrate 16 is formed with conical holes 18 having pointed bottoms 18*a* in a surface 20 thereof. Although orientation dependent etching is generally unsuitable for forming conical holes, the scope of the invention includes forming holes with conical or other pointed shapes using any appropriate means. In either case, the depth of the holes, which determines the height of the field emitters, may be selected to have any value within a wide range. It is possible within the limits of the current technology to form field emitters having heights of as low as one micron or less, with spacings between adjacent field emitters in the same range.

Figure 3A:
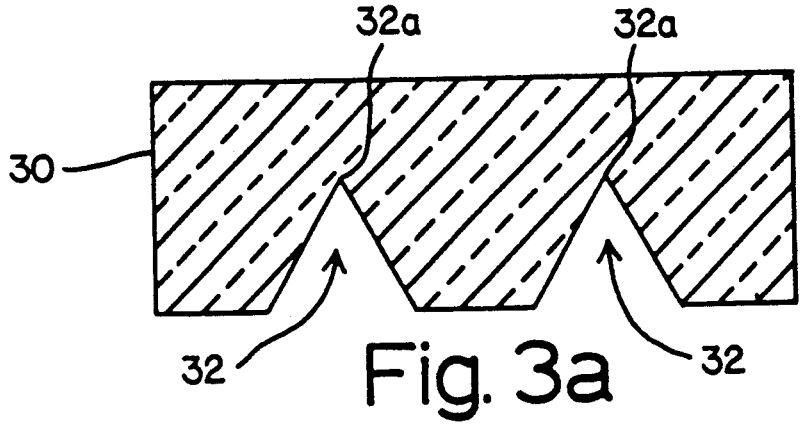
FIGS. 3*a* to 3*f* are simplified sectional views illustrating a process for fabricating a field emitter structure in accordance with the present invention.

A process for fabricating a field emitter structure in accordance with the present invention is illustrated in FIGS. 3*a* to 3*f*, in which FIG. 3*a* is a simplified cross sectional view showing a crystalline substrate 30 with holes 32 having pointed bottoms 32*a* formed in a surface 34 of the substrate 30. The substrate 30 corresponds to either of the substrates 10 or 16 of FIGS. 1 and 2 respectively, although only two holes 32 are shown for simplicity of illustration. The substrate 30 with the holes 32 formed in the surface 34 constitutes a mold for forming upstanding field emitters as will become apparent from further description.

Figure 3B:
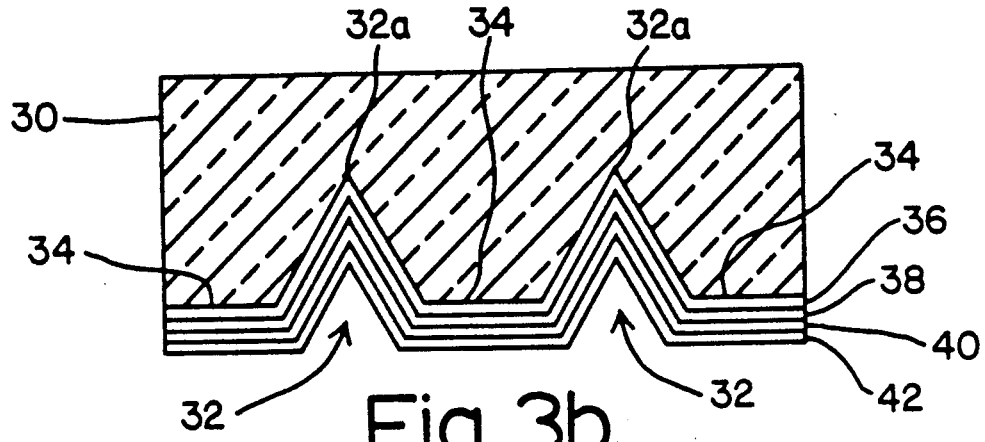

The next step of the process is illustrated in FIG. 3*b*, and includes forming successive layers 36, 38, 40, and 42 by chemical vapor deposition, evaporation, or any other suitable method on the surface 34 including the walls and bottoms of the holes 32. The thicknesses of the layers 36, 38, 40, and 42 may vary on an individual basis over a wide range depending on the particular application, from several microns, to thousands of microns or more. The layer 40 is the main operative layer of the field emitter structure, and is formed of an electrically conductive material such as molybdenum, or an alloy of titanium, tungsten, and gold. The layer 38 is optional, and is formed of a material having a lower work function than the conductive layer 40. A suitable material for the lower work function layer 38 is titanium carbide, which facilitates electron emission from the tips of the field emitters. Alternative materials for the layer 38 include refractory metals and superconductors. Specific alternative materials for the layer 38 include $LaB_6$, $GdB_4$, $YB_4$, NbC, HfC, ZrC, TaC, BaO, CaO, SrO, and $ThO_2$. The layer 36 is formed of a material such as chromium or nickel, which facilitates adhesion of the layer 38 or 40 to the silicon substrate 30. The material of the layer 36 is also selected to act as an etch stop for an etchant used to dissolve away the substrate 30 in a subsequent step. The layer 42 is formed of a high temperature brazing material such as cu sil, and is selected to be fusible to the conductive layer 40 and also to a metal mesh material in a subsequent processing step.

Figure 3C:
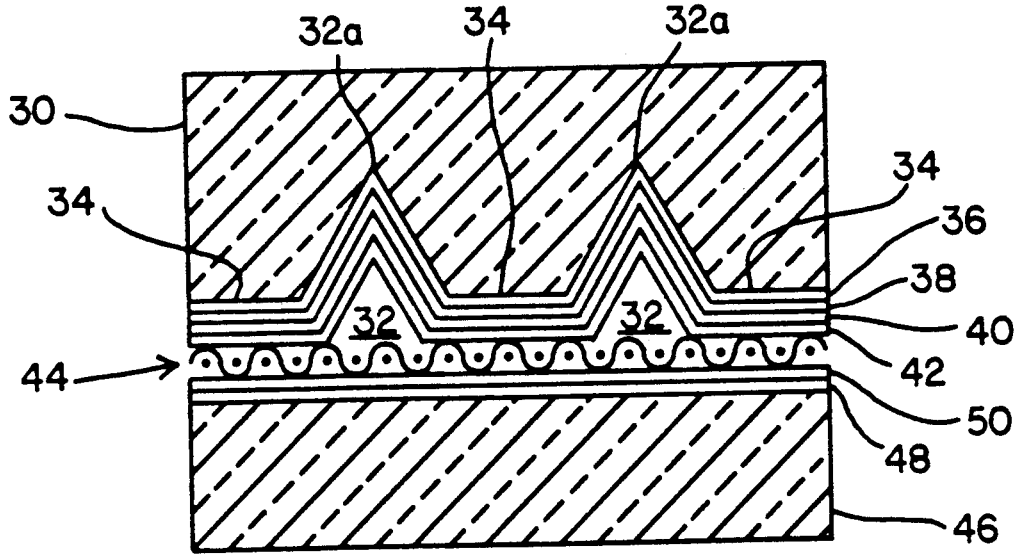

FIG. 3*c* illustrates the next step of the process, which includes brazing a screen or mesh 44 formed of an electrically conductive material such as molybdenum or copper to the conductive layer 40 via fusion provided by the brazing layer 42. The thickness of the mesh 44 may vary over a considerable range depending on the particular application, and be formed, for example, of wire having a diameter as large as several thousandths of an inch, or fibers having a diameter as small as several microns. Fabrication of the structure may be facilitated by providing a second substrate 46 formed of, for example, silicon, on which is formed an optional layer 48 of molybdenum, and a brazing material layer 50 of cu sil. The structure, with the mesh 44 sandwiched between the substrates 30 and 46, is subjected to temperature and pressure which causes the molybdenum layers 40 and 48 to be brazed to the mesh 44 in electrical connection therewith.

Figure 3D:
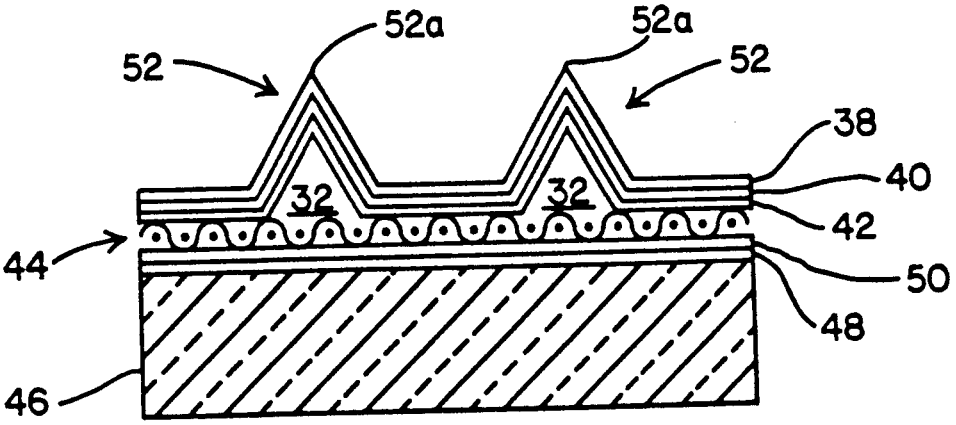

The next step of the process is illustrated in FIG. 3*d*, and includes etching or dissolving away the silicon substrate 30 from the remaining layers of the structure. A suitable etchant for this step is potassium hydroxide. Where chromium is used for the layer 36, the potassium hydroxide will cleanly remove the silicon material, but will not affect the chromium layer 36 and underlying elements.

The step of FIG. 3*d* further includes removing the chromium layer 36 to expose the molybdenum layer 40 (or the lower work function layer 38, if provided). This may be accomplished by means of etching using, for example, nitric acid, which will cleanly remove the chromium layer 36 without affecting the underlying layer 38 or 40. The field emitters can also be formed using various other techniques such as selective metal deposition, metal deposition using shadow masking, preferential etching, etc. In every case, the mesh structure could be attached to the base of the field emitters as in FIG. 3*d*.

The basic field emitter structure of the invention illustrated in FIG. 3*d* includes the mesh 44 which is electrically connected to the molybdenum layer 40. The portions of the layer 40 which were deposited on the walls and bottoms of the holes 32 in the substrate 30 constitute upstanding, hollow field emitters 52 having pointed electron-emitting tips 52*a*. The optional titanium carbide layer 38, if provided on the field emitters 52, facilitates electron emission from the tips 52*a*.

Figure 3E:
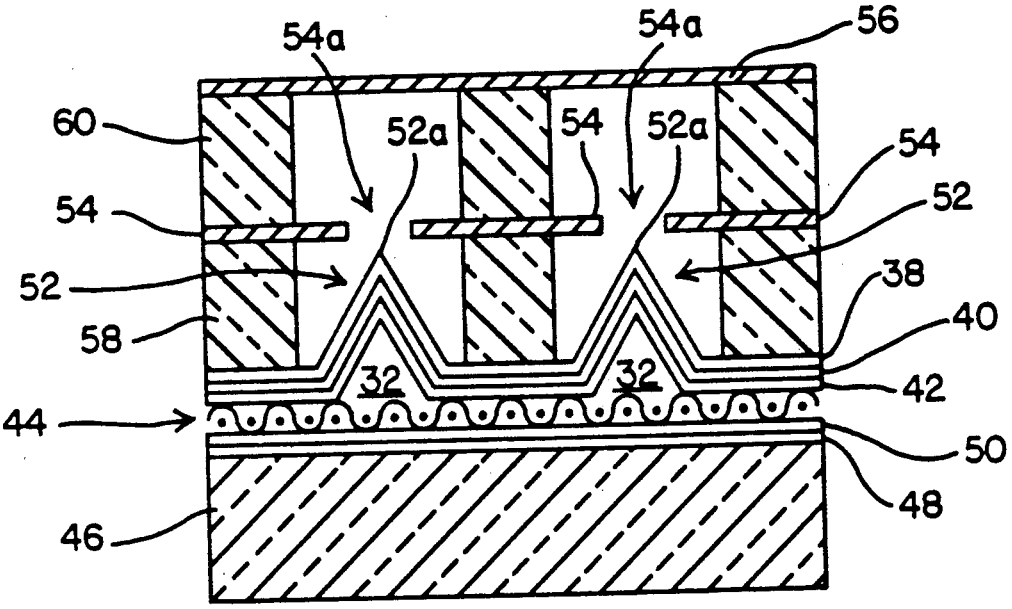

FIG. 3*e* illustrates how a field emitting triode (fetrode) configuration may be formed by adding accelerator or gate electrodes 54, and an anode electrode 56 to the basic structure. Spaces 54*a* are provided between adjacent gate electrodes 54, conjugate to or aligned with the tips 52*a* of the field emitters 52, to enable electrons emitted from the tips 52*a* to be accelerated to the anode electrode 56 in accordance with magnitudes of electrical signals applied to the gate electrodes 54 on an individual basis. The substrate 46 serves as a base or support to facilitate the fabrication of these additional elements. Further illustrated are layers 58 and 60 formed of an electrically insulative material such as silicon dioxide which serve as supports and spacers for the electrodes 54 and 56 respectively. The fabrication process for the elements 54, 56, 58, and 60 per se is not the particular subject matter of the invention, and may be performed in any manner known in the art including techniques of photolithography, chemical vapor deposition, and etching.

Figure 3F:
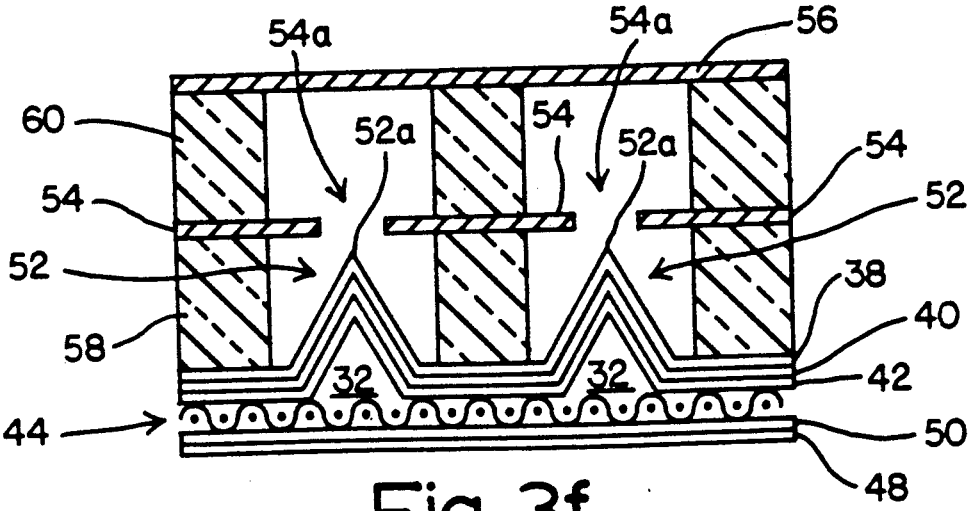

FIG. 3*f* illustrates the final step of the process, which includes removing the substrate 46 by means of, for example, dissolution in potassium hydroxide etchant.

The mesh 44 provides a strong metal base for mounting of the structure in a package using a preferred method such as high temperature soldering. The mesh 44 also has high thermal conductivity, providing dissipation of heat during fabrication and operation. The field emitter structure including the mesh 44 and molybdenum layer 40 with the field emitters 52 protruding therefrom is formed entirely of metal, providing a very high level of radiation hardness.

The space which encloses the field emitters and associated electrodes is preferably evacuated to facilitate efficient electron emission, although the structure is operable in an atmospheric ambient. In addition to providing a vacuum environment for the field emitters, it is desirable that the processing of the structure be carried out at a high enough temperature to cause substantially complete outgassing of all elements of the structure. This is accomplished by the preferred high temperature brazing process, which is typically performed within a temperature range of approximately 500°–800° C. It is possible within the scope of the invention to adhere the mesh to the field emitter layer using a process other than brazing. For example, an electrically conductive adhesive may be used for this purpose. However, it is desirable that the materials of the adhesive will not outgass during the operation of the device.

Whereas the mesh 44 has been described and illustrated as being formed separately and brazed to the substrates 30 and 46, other methods of providing a mesh in accordance with the invention are possible. For example, a mesh may be formed on the surface of the substrate 46 by an appropriate patterned deposition process.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

We claim:

1. A process for fabricating a field emitter structure, comprising the steps of:

(a) forming at least one hole having a pointed bottom in a surface of a substrate;

(b) forming an electrically conductive layer on the surface of said substrate including the walls and pointed bottom of said at least one hole;

(c) adhering an electrically conductive mesh to the conductive layer in such a manner that the mesh is electrically connected to the conductive layer; and (d) removing said substrate from the conductive layer and mesh;

whereby an upstanding pointed portion of the conductive layer corresponding to the walls and pointed bottom of each of said at least one hole respectively constitutes a field emitter.

2. A process as in claim 1, in which step (a) comprises forming said at least one hole in a pyramidal shape.

3. A process as in claim 1, in which step (a) comprises forming said at least one hole in a conical shape.

4. A process as in claim 1, in which step (a) comprises providing said substrate in the form of crystalline silicon.

5. A process as in claim 1, in which step (b) comprises forming the electrically conductive layer of molybdenum.

6. A process as in claim 1, further comprising the step, performed between steps (a) and (b), of:

(e) forming an intermediate layer on the surface of said substrate including the walls and pointed bottom of said at least one hole, the intermediate layer being adherent to said substrate and conductive layer, and resistant to a preselected etchant;

step (d) including dissolving said substrate in the preselected etchant;

the process further comprising the step, performed after step (d), of:

(f) removing the intermediate layer from the conductive layer and mesh.

7. A process as in claim 1, further comprising the step, performed between steps (a) and (b), of:

(e) forming a layer having a lower work function than the conductive layer on the surface of said substrate including the walls and pointed bottom of said at least one hole;

step (d) including removing said substrate from said lower work function layer, conductive layer, and mesh.

8. A process as in claim 7, in which:

step (b) comprises forming the conductive layer of molybdenum; and step (e) comprises forming said lower work function layer of titanium carbide.

9. A process as in claim 7, further comprising the step, performed between steps (a) and (b), of:

(f) forming an intermediate layer on the surface of said substrate including the walls and pointed bottom of said at least one hole, the intermediate layer being adherent to said substrate and said lower work function layer, and resistant to a preselected etchant;

step (d) including dissolving said substrate in the preselected etchant;

the process further comprising the step, performed after step (d), of:

(g) removing the intermediate layer from said lower work function layer, conductive layer, and mesh.

10. A process as in claim 9, in which:

step (a) includes providing said substrate in the form of crystalline silicon;

step (b) includes forming the conductive layer of molybdenum;

step (e) includes forming said lower work function layer of a material selected from the group consisting of $LaB_6$, $GdB_4$, $YB_4$, NbC, HfC, TiC, ZrC, TaC, BaO, CaO, SrO, and $ThO_2$; and step (f) includes forming the intermediate layer of chromium.

11. A process as in claim 10, in which step (d) comprises dissolving said substrate in the preselected etchant which includes potassium hydroxide.

12. A process as in claim 1, in which step (c) further comprises adhering a second substrate to the mesh in such a manner that the mesh is sandwiched between said substrate and the second substrate.

13. A process as in claim 12, further comprising the step, performed after step (d), of:

(e) removing the second substrate from the conductive layer and mesh.

14. A process as in claim 13, further comprising the step, performed between steps (d) and (e), of:

(f) forming gate means on the conductive layer conjugate to each field emitter respectively.

15. A process as in claim 1, in which step (c) comprises adhering the mesh to the conductive layer by a thermal fusion process at a temperature high enough to cause substantially complete outgassing of said substrate, conductive layer, and mesh.

16. A process as in claim 15, in which step (c) comprises adhering the mesh to the conductive layer by brazing.

17. A process as in claim 16, further comprising the step, performed between steps (b) and (c), of:

(e) forming a layer of brazing material on the conductive layer, the brazing material being selected to thermally fuse to the conductive layer and mesh in step (c).

18. A process as in claim 17, in which step (c) comprises providing the mesh formed of a material selected from the group consisting of tungsten and copper.

19. A field emitter structure, comprising:

an electrically conductive layer having at least one upstanding pointed portion which constitutes a field emitter extending from a first surface thereof; and an electrically conductive mesh adhered to a second surface of the conductive layer which is opposite to the first surface thereof, the mesh being electrically connected to the conductive layer.

20. A structure as in claim 19, in which said at least one upstanding pointed portion is hollow.

21. A structure as in claim 19, in which said at least one upstanding pointed portion has a conical shape.

22. A structure as in claim 19, in which said at least one upstanding pointed portion has a pyramidal shape.

23. A structure as in claim 19, further comprising gate means provided on the first surface of the conductive layer conjugate to each field emitter respectively.

24. A structure as in claim 19, further comprising a layer having a lower work function than the conductive layer formed over said at least one upstanding portion.

25. A structure as in claim 24, in which the conductive layer comprises molybdenum, and said lower work function layer comprises titanium carbide.

26. A structure as in claim 19, further comprising a high temperature brazing layer which thermally fuses the mesh to the second surface of the conductive layer.

27. A structure as in claim 19, in which the conductive layer comprises tungsten, and the mesh comprises a material selected from the group consisting of tungsten and copper.

* * * * *